US007347461B2

(12) United States Patent
Sprague

(10) Patent No.: US 7,347,461 B2
(45) Date of Patent: Mar. 25, 2008

(54) DOOR HANDLE ACTUATED ELECTRONIC EGRESS SYSTEM

(75) Inventor: Gary Sprague, Redondo Beach, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 93 days.

(21) Appl. No.: 10/299,422

(22) Filed: Nov. 18, 2002

(65) Prior Publication Data

US 2004/0094972 A1 May 20, 2004

(51) Int. Cl.
*E05B 3/00* (2006.01)

(52) U.S. Cl. ..... 292/336.3; 200/61.62

(58) Field of Classification Search ..... 292/251.5, 292/144, 336.3; 200/61.62
See application file for complete search history.

(56) References Cited

U.S. PATENT DOCUMENTS 1,165,436 A * 12/1915 Mochau ..... 292/93
3,020,038 A * 2/1962 Simpson ..... 49/32
3,031,546 A * 4/1962 Williams ..... 200/61.62
3,563,586 A * 2/1971 Creamer et al. ..... 292/144
3,662,482 A 5/1972 Sarkisian
3,801,144 A 4/1974 Diehl
3,811,176 A 5/1974 Horgan, Jr.
4,154,997 A * 5/1979 Grebner et al. ..... 200/536
D267,274 S 12/1982 Horgan, Jr.
D267,275 S 12/1982 Horgan, Jr.
D267,276 S 12/1982 Horgan, Jr.
4,366,974 A 1/1983 Horgan, Jr.
4,382,620 A 5/1983 Horgan, Jr.
4,418,949 A 12/1983 Horgan, Jr.
4,506,922 A 3/1985 Horgan, Jr.
4,523,414 A 6/1985 Horgan, Jr.
4,680,903 A 7/1987 Horgan, Jr.
4,688,406 A 8/1987 Horgan, Jr.
4,711,480 A 12/1987 Horgan, Jr.
4,762,348 A * 8/1988 Matsumoto ..... 292/201
4,763,453 A 8/1988 Horgan, Jr.
4,871,204 A * 10/1989 Cook et al. ..... 292/251.5
4,895,399 A 1/1990 Horgan, Jr.
4,901,545 A * 2/1990 Bacon et al. ..... 70/278.3

(Continued)

FOREIGN PATENT DOCUMENTS

DE 84 00 936 U1 4/1986

(Continued)

OTHER PUBLICATIONS

"Access Control Hardware," Custom Hardware Manufacturing, Inc. brochure, at least as early as Nov. 14, 2002, pp. 1-4, Keokuk, Iowa, United States of America.

(Continued)

*Primary Examiner*—Gary Estremsky
(74) *Attorney, Agent, or Firm*—Mitchell P. Brook; Luce, Forward, Hamilton, Scripps LLP

(57) ABSTRACT

An electronic egress system includes at least one door, each door having a handle defining an interior area, an actuator and an exit control assembly including a switch assembly located substantially within the handle's interior. The handle is movable relative to the actuator such that motion of the handle relative the actuator changes the switch assembly from a first switch state to a second switch state.

19 Claims, 12 Drawing Sheets

U.S. PATENT DOCUMENTS

| | | | | |
|---|---|---|---|---|
| 4,956,954 | A | 9/1990 | Horgan, Jr. | |
| 4,976,476 | A * | 12/1990 | Cross et al. | 292/92 |
| 5,283,978 | A | 2/1994 | Horgan, Jr. | |
| 5,429,399 | A * | 7/1995 | Geringer et al. | 292/92 |
| 5,615,918 | A * | 4/1997 | Ferrell | 292/92 |
| 5,969,440 | A * | 10/1999 | Young et al. | 307/119 |
| D444,241 | S | 6/2001 | Horgan, Jr. | |
| 6,486,793 | B1 * | 11/2002 | Buccola | 340/5.2 |
| 6,714,118 | B1 * | 3/2004 | Frolov et al. | 340/5.7 |

FOREIGN PATENT DOCUMENTS

| | | |
|---|---|---|
| EP | 0388379 A1 | 9/1990 |

OTHER PUBLICATIONS

John S. Belrose, "Fessenden and the Early History of Radio Science", The Radioscientist 5(3), (Sep. 3, 1994).

T. Rappaport, "Introduction to Wireless Communication Systems", Wireless Communications: Principles And Practice, Chapter 1 (2d. Ed. 2001).

* cited by examiner

DOOR HANDLE ACTUATED ELECTRONIC EGRESS SYSTEM

FIELD OF THE INVENTION

The present invention is directed to electronic handle activated door locks.

BACKGROUND OF THE INVENTION

Various doors with electronically actuated locking or latching mechanisms exist in which wires associated with the electronics are positioned within the interior of the door body. For doors that are opaque and hollow this may be visually acceptable as the door body serves to shield from view the wires and other electronic components.

For transparent doors, such as glass doors, typically a glass panel construction is used for the door body. In such a construction it is difficult to place wires within the glass panel of the door, especially if it is desired to hide the wires. In one known glass door design electronic components and wires are positioned within a tubular, metallic door handle. An example is shown in U.S. Pat. No. 5,615,918, which illustrates a door handle with a capacitance sensor positioned in it. However, this kind of sensor can suffer deficiencies, such as requiring relatively complex or expensive electronic components, and can be subject to unreliability in some conditions, such as if a user's hands are insulated, such as by wearing gloves, and some types of prostheses may not actuate the components to unlock the door. Likewise, introduction of moisture can interfere with operation of the sensor.

Accordingly, there exists a need for a reliable and durable electronically controlled door locking/unlocking system that is arranged to shield from view the wiring and electronic components.

SUMMARY OF THE INVENTION

The present invention alleviates to a great extent the disadvantages of the known apparatus and methods of door release systems by providing a door handle actuated electronic egress system in which an switch is positioned generally within the body of a door handle. The switch is actuated by physical displacement of a door handle relative to the door body, such as by user actuation. Actuation of the switch results in a signal being transmitted via preferably concealed wires, or alternatively wirelessly, to an electronic lock or an electronic latch (collectively referred to as either an electronic "lock" or "latch" herein) in the door header. According to some embodiments, a pivotally mounted door handle actuates the switch when the handle is displaced relative to the door body.

Some embodiments of the present invention involve an electronic egress system including a door panel, a movable component mounted to the door panel such as using a pivot assembly or pivot assemblies whereby the movable component can move relative to the door panel upon being activated by a force input, a switch assembly outputting a switch signal when the movable component is displaced a predetermined distance relative to the door panel, and a latching assembly responsive to the switch signal to move into an unlatched position.

Other embodiments of the invention involve an electronic egress system including a door panel, at least one movable connector, a movable component mounted to the door panel using the movable connector whereby the movable component can move relative to the door panel upon being activated by a force input, a switch assembly outputting a switch signal when the movable component is displaced a predetermined distance relative to the door panel, a latching assembly responsive to the switch signal to move into an unlatched position, and a top door rail assembly, wherein the movable component is a door handle defining an interior hollow portion, the door handle extending to a top door rail and/or bottom door rail assembly, wherein the switch assembly is situated within the interior hollow portion of the door handle, wherein the door panel is pivotally mounted to a door frame (such as in its header and/or footer, the footer being for example a threshold or coverplate or merely a pivot receiving aperture) about a pivot axis, wherein the latching assembly is situated in the header of the door frame above the top door rail assembly, and wherein the electrically conductive path includes conductive wires extending from the switch assembly through the interior hollow portion of the door handle to the top door rail assembly and extending in the top door rail assembly towards the pivot axis, out of the top door rail assembly and into the header above the top door rail assembly and to the latching assembly.

Further embodiments of the present invention involve an electronic egress system comprising a door having a door body, handle defining an interior area, an actuator and an exit control including a switch located substantially within the interior area, wherein the handle is movable relative to the actuator such that motion of the handle relative the actuator changes the switch from a first switch state to a second switch state.

Additional embodiments of the present invention involve an electronic egress system comprising a door having a handle defining an interior area, an actuator and an exit control assembly including a switch assembly located substantially within the handle's interior, wherein the actuator is adapted to penetrate an opening in the handle and make contact with the exit control assembly when sufficient force is applied to the handle, wherein contact between the actuator and the exit control assembly causes the switch to be changed from the first switch state to the second switch state.

Further embodiments of the present invention involve an electronic egress system comprising a door having a handle defining an interior area, an actuator and an exit control assembly including a switch located substantially within the handle, wherein the handle is movable relative to the actuator such that motion of the handle relative the actuator changes the switch assembly from a first switch state to a second switch state. The electronic egress system further comprises a top door rail, a header and an electromagnetic lock assembly including an electromagnetic component located within the header and an armature located within the top door rail, wherein the switch assembly is adapted to activate and de-activate the lock assembly, wherein the armature is dimensioned to fit at least partially within a similarly shaped opening in the electromagnetic component, wherein the lock assembly is attached to the switch assembly via electrical wires, wherein the wires are threaded from the switch assembly, up through the vertical bar, into the top door rail, and up into the header to the lock assembly.

Other embodiments of the present invention involve an electronic egress system comprising a door having a handle, an actuator and an exit control assembly including a switch assembly located substantially within the handle, wherein the handle is attached to the door at a pair of pivot points, wherein the handle includes a vertical bar and a horizontal bar, which are pivotally attached to the door at the pivot points.

Further embodiments of the present invention involve an electronic egress system including two doors, each door having a handle, an actuator and an exit control assembly including a switch assembly located substantially within the handle, wherein the handle is movable relative to the actuator such that motion of the handle relative the actuator changes the switch assembly from a first switch state to a second switch state.

These and other features and advantages of the present invention will be appreciated from review of the following detailed description of the invention, along with the accompanying figures in which like reference numerals refer to like parts throughout.

DETAILED DESCRIPTION

Figure 1:
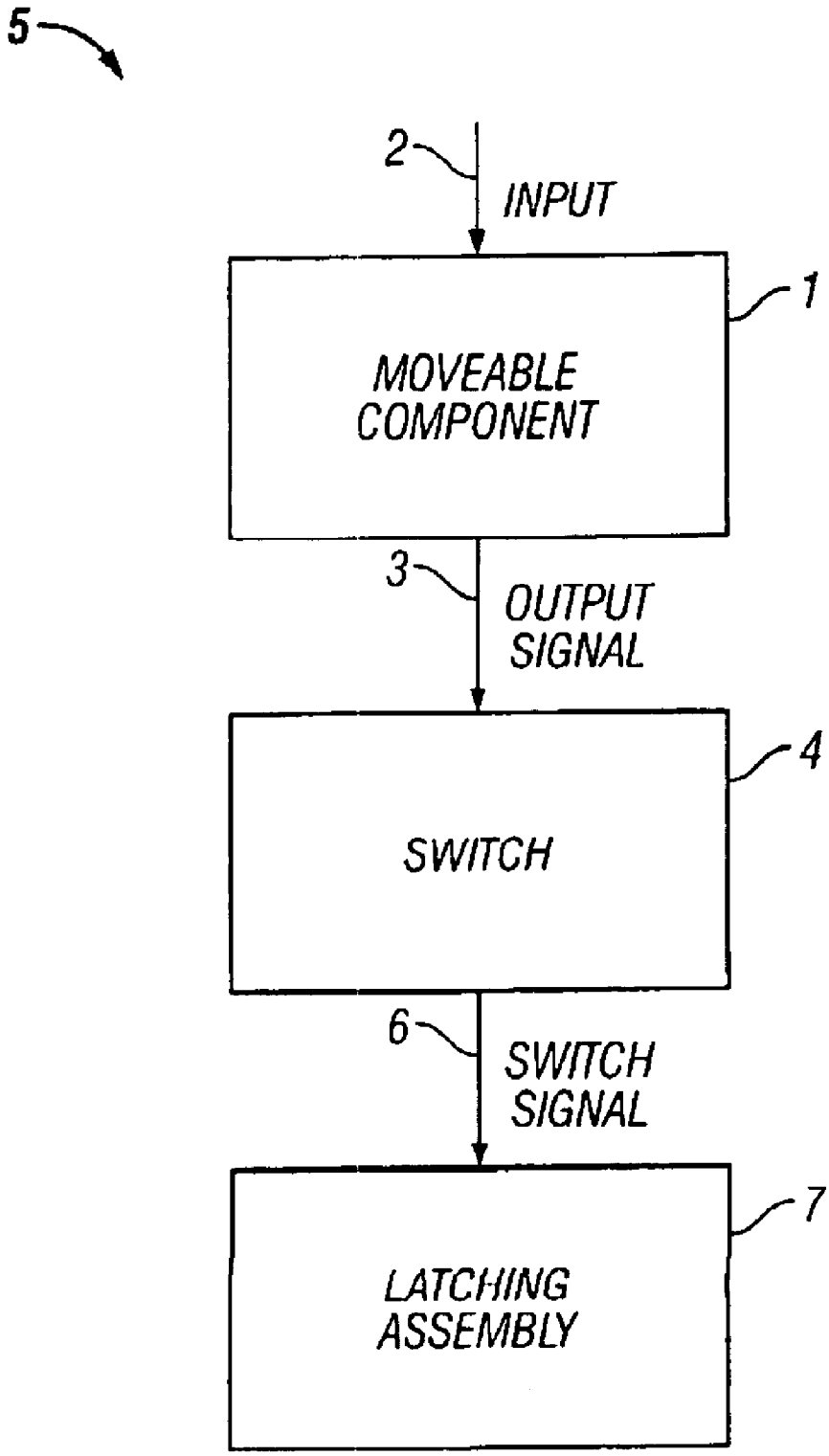
FIG. 1 is a schematic diagram of an electronic egress system in accordance with the present invention.

FIGS. 1-14 illustrate various embodiments of a door handle actuated electronic egress system 5 ("electronic egress system") according to the present invention. Generally speaking, the system 5 includes a movable component 1 that can receive actuation via a pressure input 2. Typically the pressure input would be by a person seeking to open a door pushing on the movable component 1, such as by hand, back, foot or other body part. Alternatively a mechanical pressure input 2 could be provided such as via a wheelchair or other assistant device such as prosthesis or cane. The movable component 1 can be any component that can withstand the pressure input and move at least a predetermined distance as desired from the pressure input 2. The predetermined distance can be any desired distance sufficient to ultimately actuate switch 4, and need not be the entire range of motion of the movable component 1. For example, the predetermined distance can be in the range of 1 mm. to 20 cm., although any distance outside of that range also may be selected. In one example, the movable component is a door handle appropriately mounted so as to displace relative to the door body 20 in response to the pressure input 2. Upon actuation of the movable component 1 by the pressure input 2, an output signal 3 is generated, such as a mechanical motion of a linkage or other mechanical translation actuator. Alternatively, an electronic signal can be generated using an electronic actuator. The output signal is received by a switch 4, which in turn outputs switch signal 6. Switch signal 6 alternatively can be an analog electrical signal, digital signal, or alternatively a wireless signal of any desired format. The switch signal is transmitted to a locking or latching assembly 7, which is actuated by the signal to unlock or unlatch the door (as used herein "locking", "latching", "unlocking" and "unlatching" will be used interchangeably to refer to actuating or de-actuating a mechanical, and/or electrical, and/or magnetic assembly that is operated to allow or impede motion of the door, such as opening or closing). For example, the locking or latching assembly 7 can receive an analog signal that operates an electronic unlocking or unlatching mechanism in the locking or latching assembly 7. Alternatively, locking or latching apparatus may receive a digital signal 6, and include an AID converter that converts the digital signal into an analog signal and thereby operates an electronic unlocking or unlatching mechanism. In a wireless embodiment, the locking or latching mechanism 7 includes a wireless receiver that receives signal 6, and operates to unlock or unlatch the door.

Figure 2:
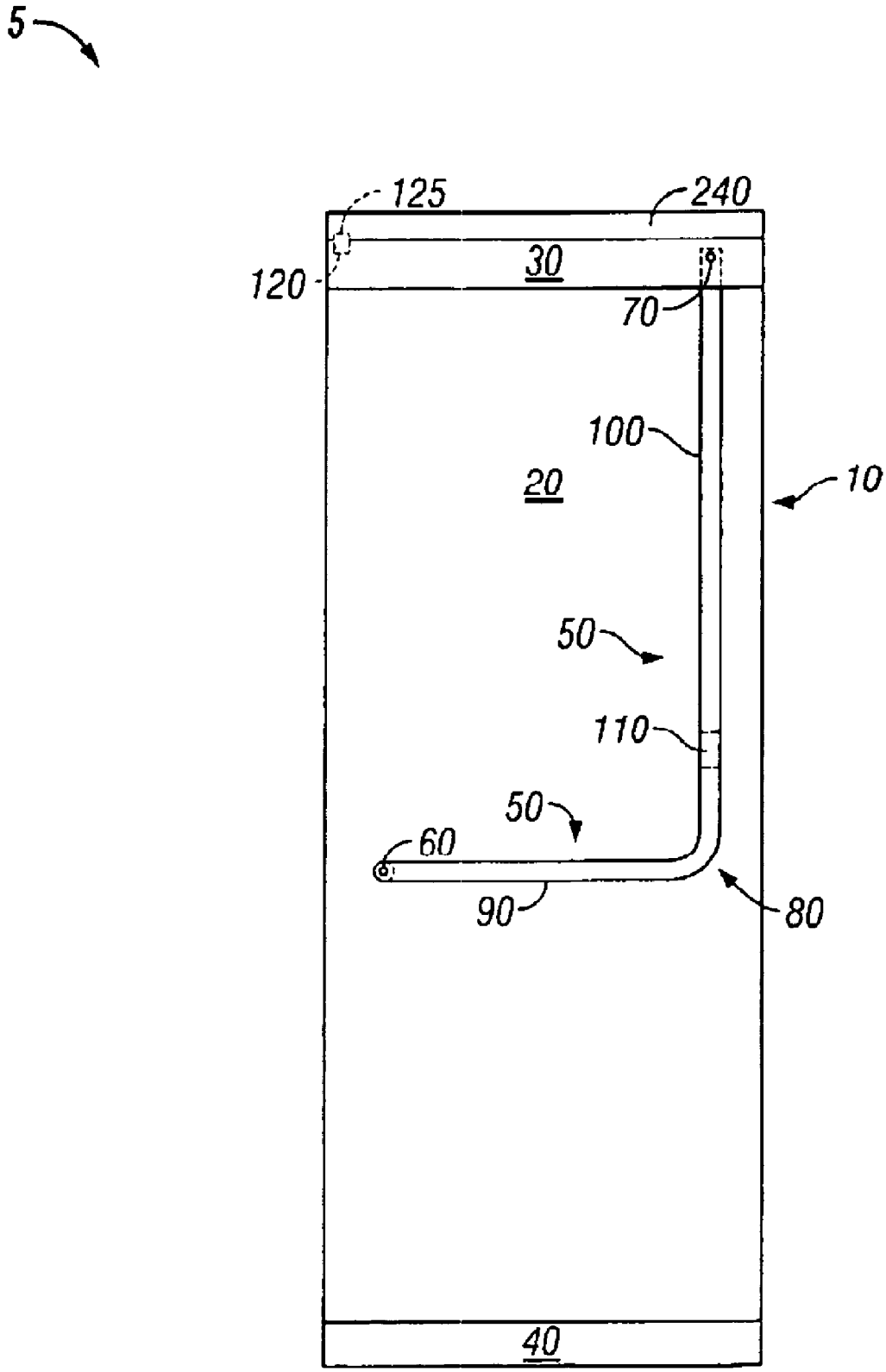
FIG. 2 is a front view of an embodiment of an electronic egress system in accordance with the present invention.

Turning to a specific embodiment, as depicted in FIG. 2, the electronic egress system 5 comprises a door 10 including a door body or door panel 20 having a one of a top door rail 30 or a bottom door rail 40 affixed thereto. In an alternative embodiment, the system includes both a top door rail 30 and bottom door rail 40, as illustrated in FIG. 2. A handle 50 is mounted onto the panel 20. The handle 50, in at least some portion of it defines an interior space, i.e. is hollow. The handle 50 can be attached to the door in any fashion. In one embodiment, the handle 50 is pivotally mounted to the door at pivot assemblies 60, 70 ("pivot assemblies" may include any type of connector and also are referred to herein as "pivot points" or "pivot connectors") near or at its respective ends. Alternatively, it may have a single pivot point or any other number of pivot points such that the handle can be mounted to the door body 20. Any type of pivot assembly or other type of connector assembly may be used that is sufficient to mount the handle 1 to the door body 20 while still enabling relative motion between the handle 50 and door body 20 at a desired location on the handle 50.

Figure 6:
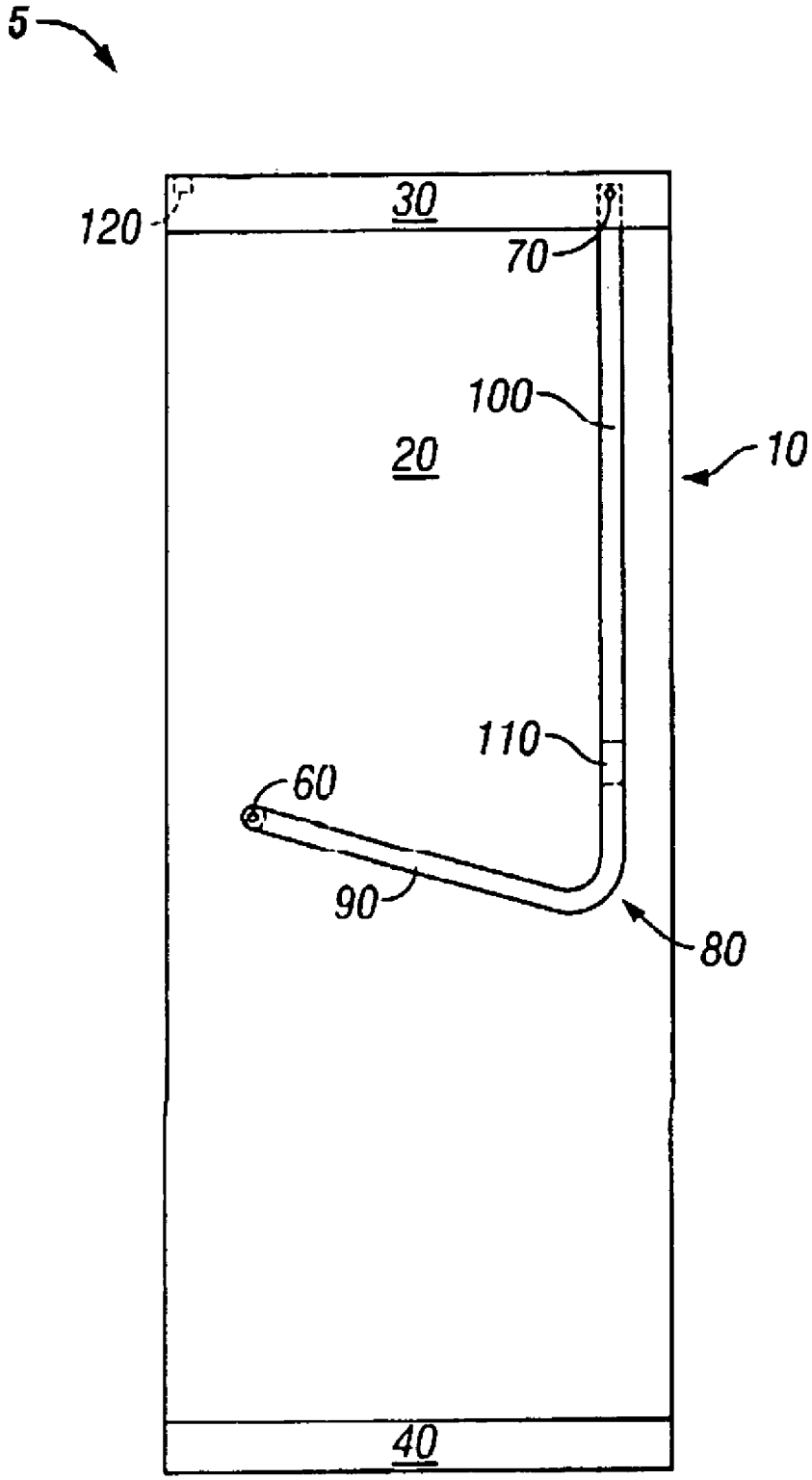
FIG. 6 is a front view of an embodiment of an electronic egress system in accordance with the present invention.
Figure 7:
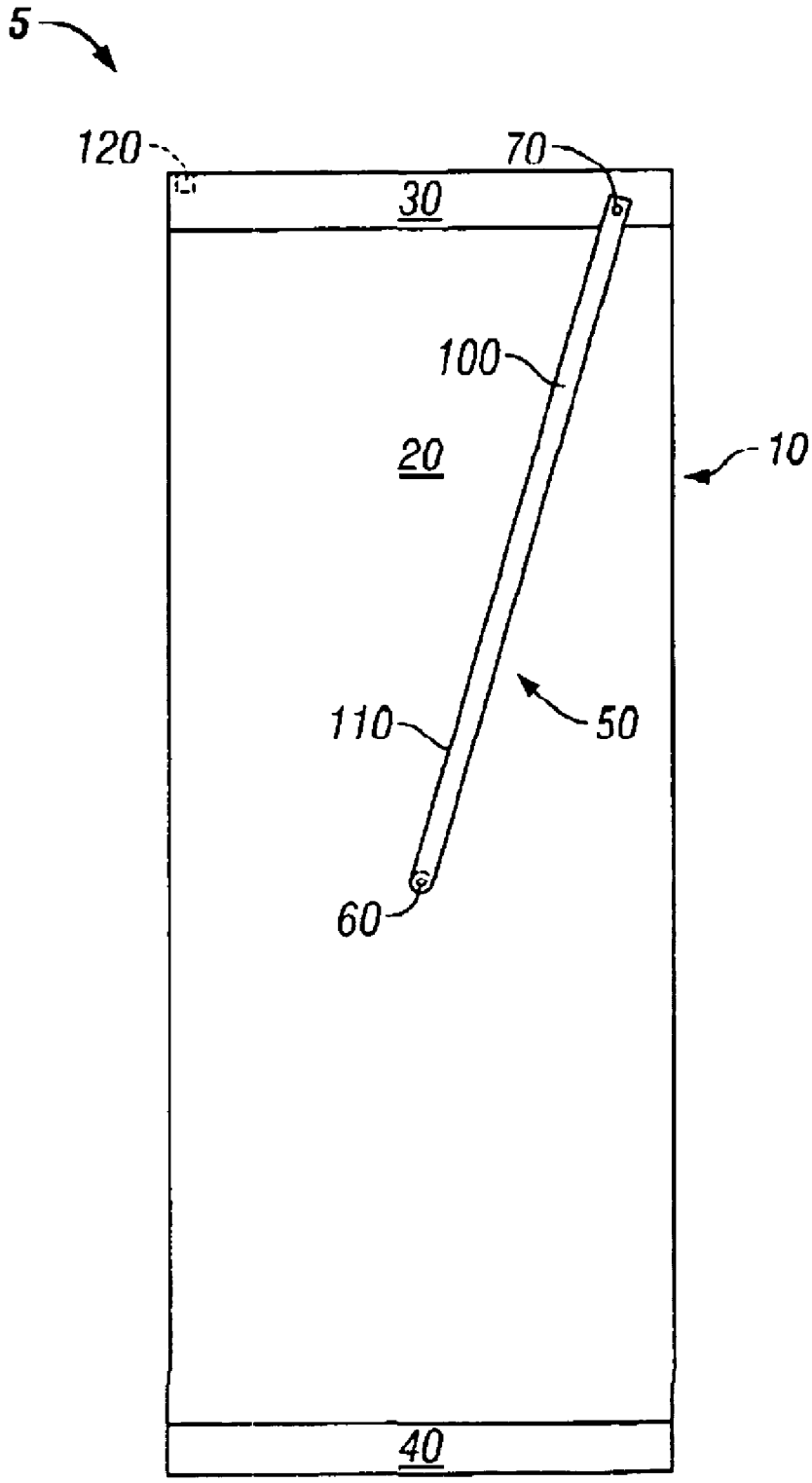
FIG. 7 is a front view of an embodiment of an electronic egress system in accordance with the present invention.
Figure 8:
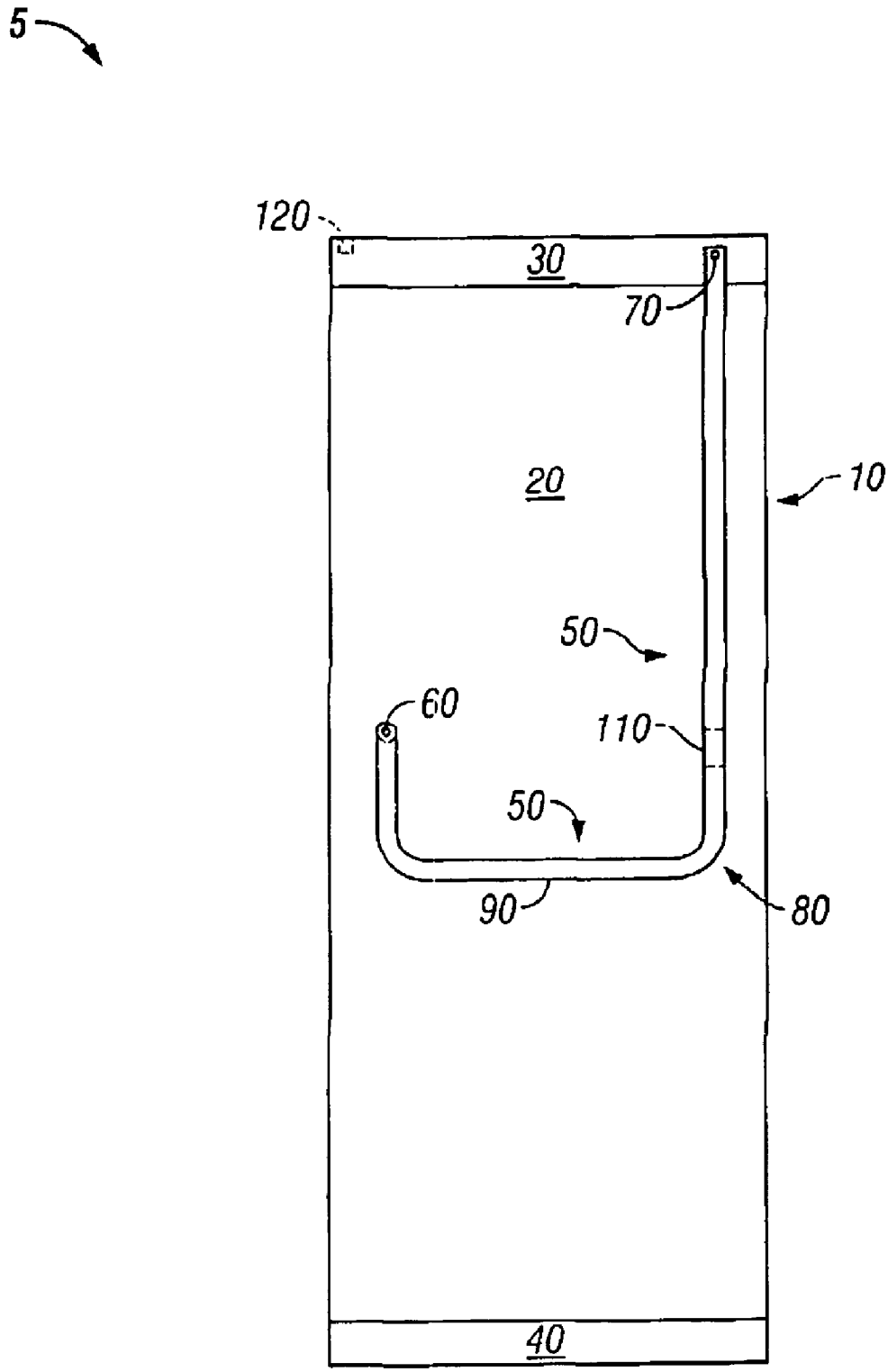
FIG. 8 is a front view of an embodiment of an electronic egress system in accordance with the present invention.

Any shaped handle may be used. For a displaceable door handle embodiment, as illustrated in FIGS. 2-8, a bent handle 50 may be used, in various shapes, such as L-shaped, J-shaped, angled etc. In an illustrated embodiment, the handle 50 has a bend 80 forming a generally horizontal portion 90 (also called "horizontal bar") and a vertical portion 100 (also called "vertical bar". In the embodiment shown in FIGS. 2-8 a generally 90 degree angle is provided at bend 80. However, as seen in FIG. 6, any other angle maybe used as well, including, but not limited to 30, 60, 85, 95, 120 and 150 degree angles. Alternatively there may be no bend at all, as illustrated in FIG. 7 or several bends, as illustrated in FIG. 8.

In a wired embodiment of the egress system of the present invention, at least a portion of the handle 50 extends to at least one of the top door rail 30 or the bottom door rail 40. In a wireless version, the handle 50 optionally may extend to at least one of the top door rail 30 or the bottom door rail 40, but optionally does not so extend.

In one embodiment, the handle 50 is movable in reference to an actuator post 110. The actuator post 110 is used to actuate a switch assembly within the vertical bar 100 and unlock the door 10. When sufficient force is applied, the handle 50 moves relative to the actuator post 110 such that the actuator post 110 further extends within an aperture defined within the handle 50. The actuator post 110 engages a linkage, which in turn actuates the switch 4, or alternatively itself actuates the switch 4. Preferably, the handle 50 meets the standards set forth by the Americans With Disabilities Act (ADA) such that a force of less than 15 pounds applied to the handle 50 is sufficient to open the door 10. However, any force may be applied that can sufficiently displace the handle 50 so as to result in actuation of the switch 4 and thereby generating switch signal 6.

The door 10 is adapted be attached to a header 240 in the door frame by any mounting apparatus. As seen in FIG. 2, in one embodiment, a pivot assembly 115 is provided. In the pivot assembly 115, the door top door rail 30 includes a pivot member 120 extending therefrom and being received in a female pivot receiving plate 125. A similar or other type of pivoting assembly may also be provided at the bottom of the door 20 as well. Alternatively, the door is hinged by any hinging apparatus at one of its sides, such that it can be opened by rotating using hinge apparatus. Alternatively, the door may be a pocket door in which the door panel 20 may slide into a space (not shown) provided in the door frame.

According to some embodiments, the panel 20 is a frameless glass panel 20 formed of tempered glass (or any other type of clear material of sufficient strength and structural integrity to serve as a door). However, it should be understood to those of skill in the art that the panel 20 could be made from wood, metal, plastic or other material without departing from the scope of the present invention and that any form of mounting apparatus may be used. As discussed above, any form of assemblies can be used to mount the handle. For example, pivoting assemblies 60, 70 can be mounted via holes and mechanical securing assembly (such as bolts, screws, posts or any other apparatus of sufficient strength to mount the assemblies) in the door panel 20 that entirely or partially extend through the holes. Alternatively they can be adhesively mounted. Likewise the optional actuator post 110 can be mounted via a hole in the door panel 20, or alternatively via adhesive.

Figure 3:
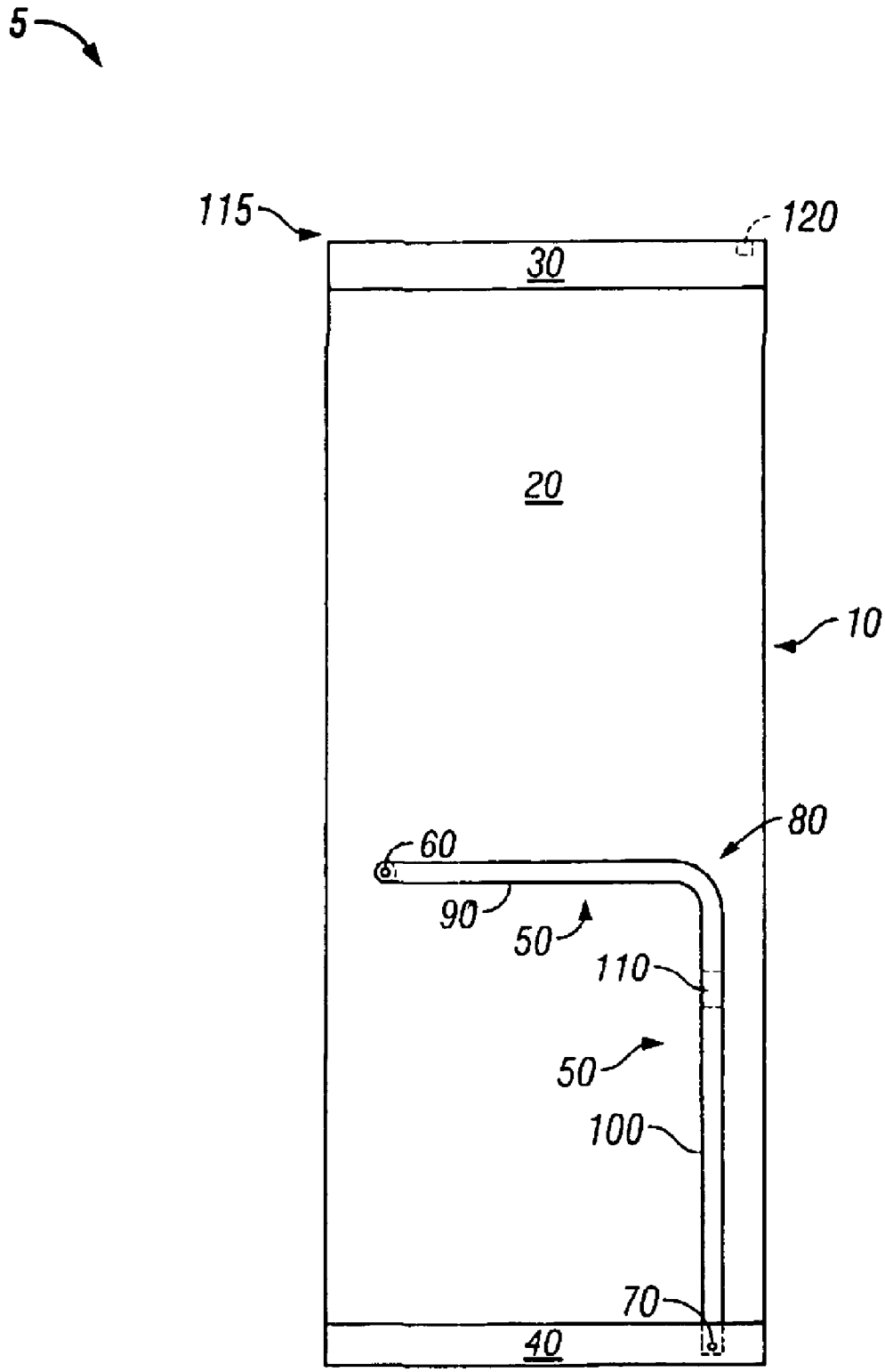
FIG. 3 is a front view of an embodiment of an electronic egress system in accordance with the present invention.

As seen in FIG. 3, according to another embodiment, the electronic egress system 5 comprises a door 10 including a panel 20 having a top door rail 30 and bottom door rail 40. In this embodiment, the handle 50 is bent (at 80) forming a horizontal bar 90 and a vertical bar 100 that extends downward into bottom door rail 40. As before, an actuator post 110 is used to actuate a switch assembly within the vertical bar 100 and unlock the door 10. Pivot members 120 are structured to pivotally mount door 10 to an appropriate door frame, such as at the header and footer of the door frame.

Figure 4:
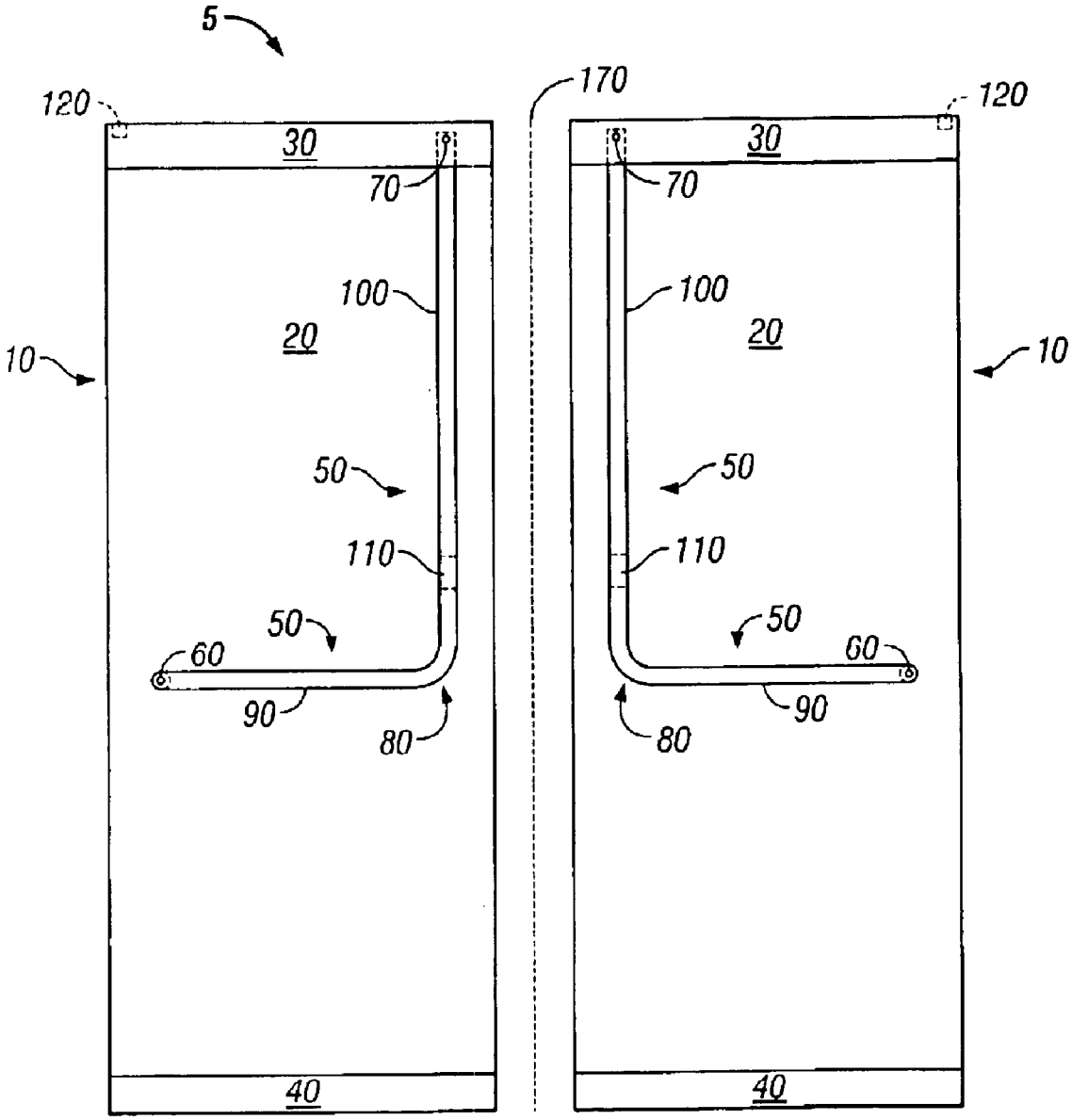
FIG. 4 is a front view of an embodiment of an electronic egress system in accordance with the present invention.

As seen in FIG. 4, according to another embodiment, the electronic egress system 5 comprises double doors 10,10. Elements analogous to those described above with respect to FIGS. 2 and 3 have been numbered accordingly. The doors 10,10 are mirror images of each other about centerline 170 such that one handle 50 is L-shaped and the other handle 50 has an inverted L-shape. In this embodiment, the handles 50,50 are bent (at 80,80) forming horizontal bars 90,90 and vertical bars 100,100 that extend upward into top door rails 30,30. Also, since the hinges 120,120 are located distally from the centerline 170, the doors 10,10 rotate outwardly and away from the centerline 170 when the handles 50,50 are pushed.

Figure 5:
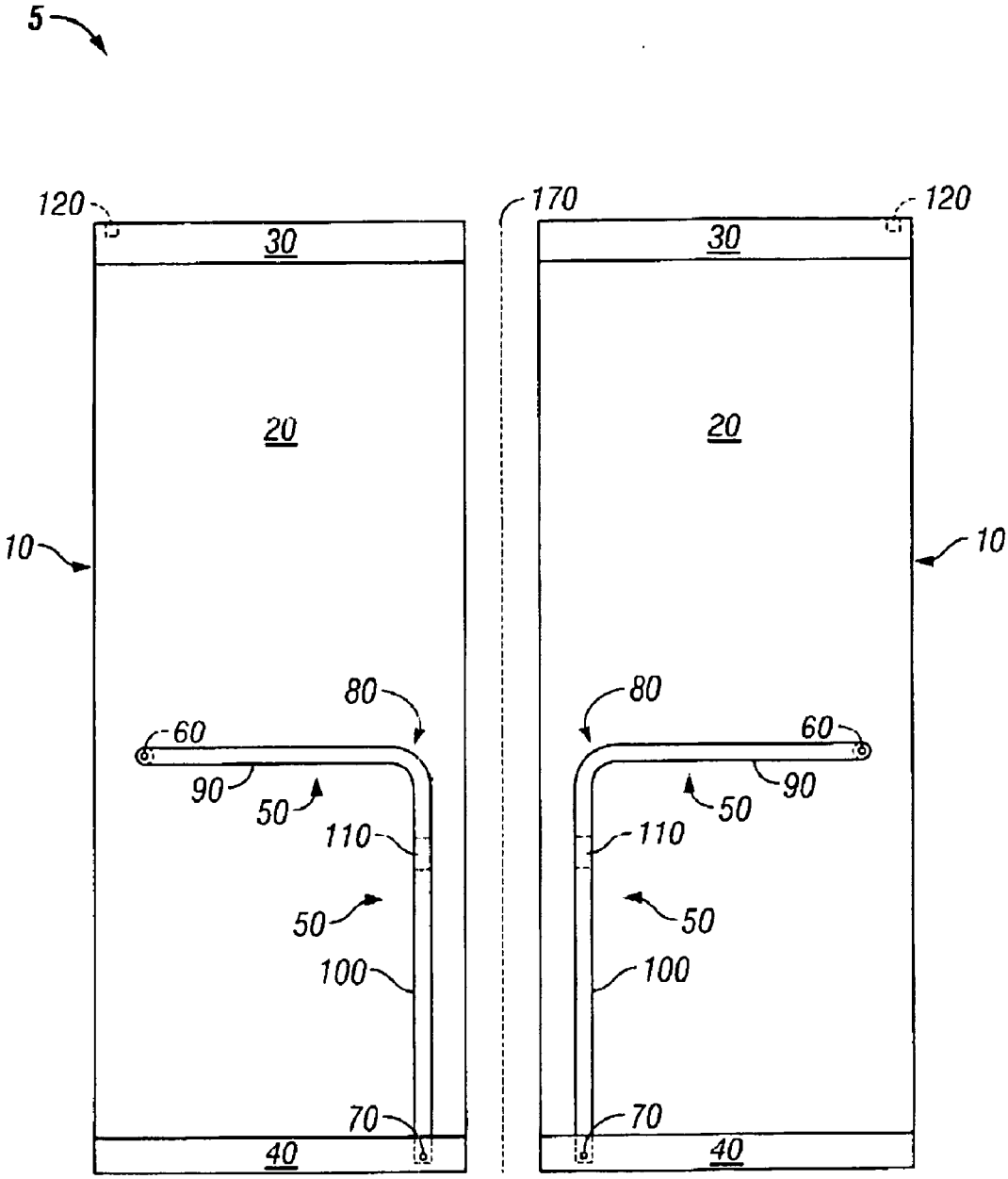
FIG. 5 is a front view of an embodiment of an electronic egress system in accordance with the present invention.

As seen in FIG. 5, according to another embodiment, the electronic egress system 5 comprises double doors 10,10. Elements analogous to those described above with respect to FIGS. 2-4 have been numbered accordingly. As before, the doors 10,10 are mirror images of each other about centerline 170. In this embodiment, the handles 50,50 are bent (at 80,80) forming horizontal bars 90,90 and vertical bars 100,100 that extend downward into bottom door rails 40,40.

Figure 9:
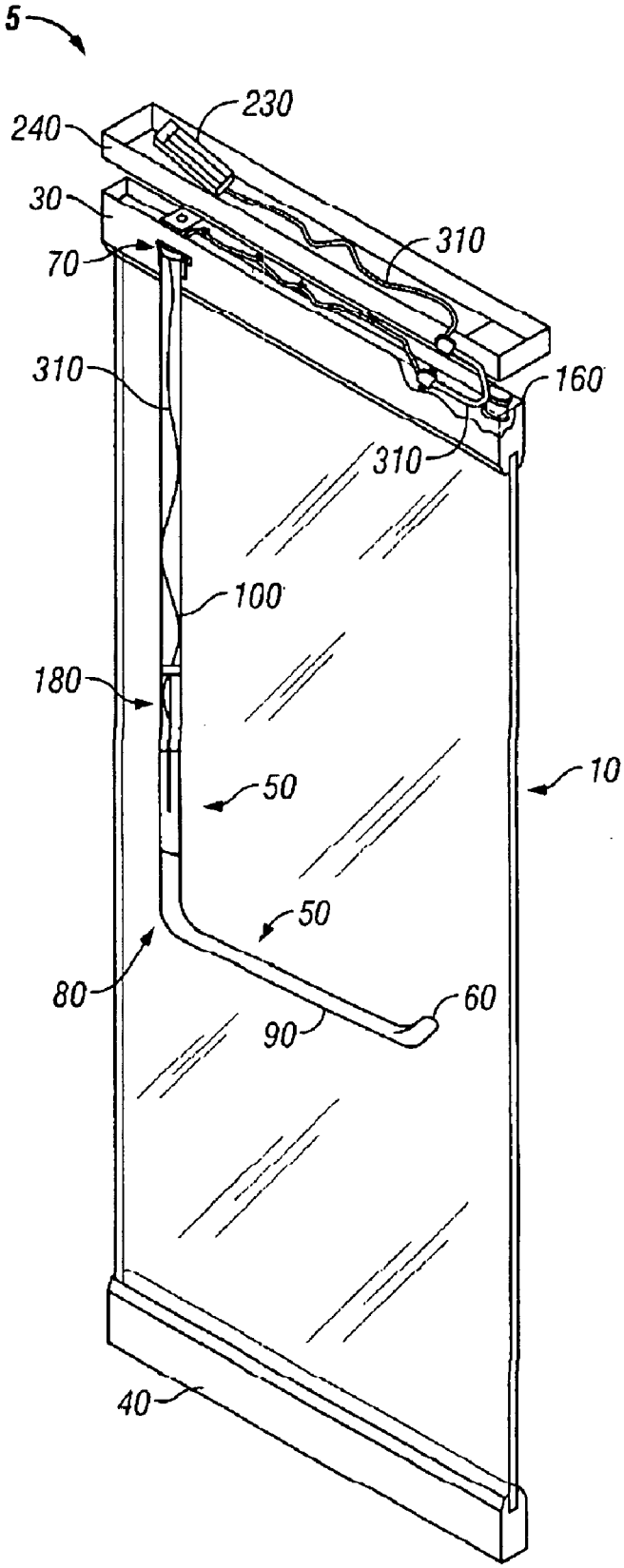
FIG. 9 is a perspective view of an embodiment of an electronic egress system in accordance with the present invention.
Figure 10:
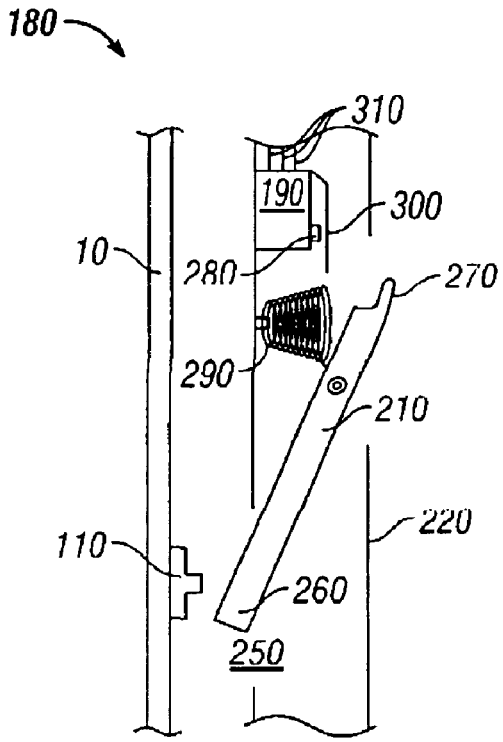
FIG. 10 is a cross-sectional view of an embodiment of an electronic egress system in accordance with the present invention.
Figure 11:
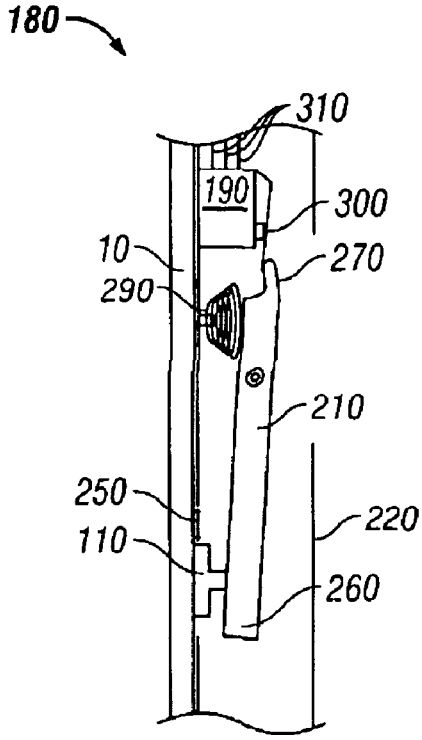
FIG. 11 is a cross-sectional view of an embodiment of an electronic egress system in accordance with the present invention.

As seen in FIGS. 9-11, the electronic egress system 10 further includes an exit control device 180 mounted inside of the vertical bar 100. As best seen in FIGS. 10 and 11, the exit control device 180 includes a switch assembly 190 and a linkage 210 mounted within tubing 220. In a preferred embodiment, the linkage 210 is pivotally mounted, such as in a momentary contact switch. In operation, pressure is applied at one end of the linkage 210, such as at end 260, causing the linkage 210 to pivot, and the opposite end 270 coming into contact with electrical contact 300. Preferably, the tubing 220 is stainless steel tubing 220 with a high quality finish, although any suitable material may be used. According to some embodiments, the switch assembly 190 is a single pole, double throw ("SPDT") switch 190. Preferably a switch is selected having a long operational life and includes a waterproof body, so as to protect from environmental conditions. When the handle 150 is depressed, the switch assembly 190 activates or de-activates a lock assembly 230 located at least partially within header 240. In this embodiment, the exit control device includes switch 4.

Figure 12:
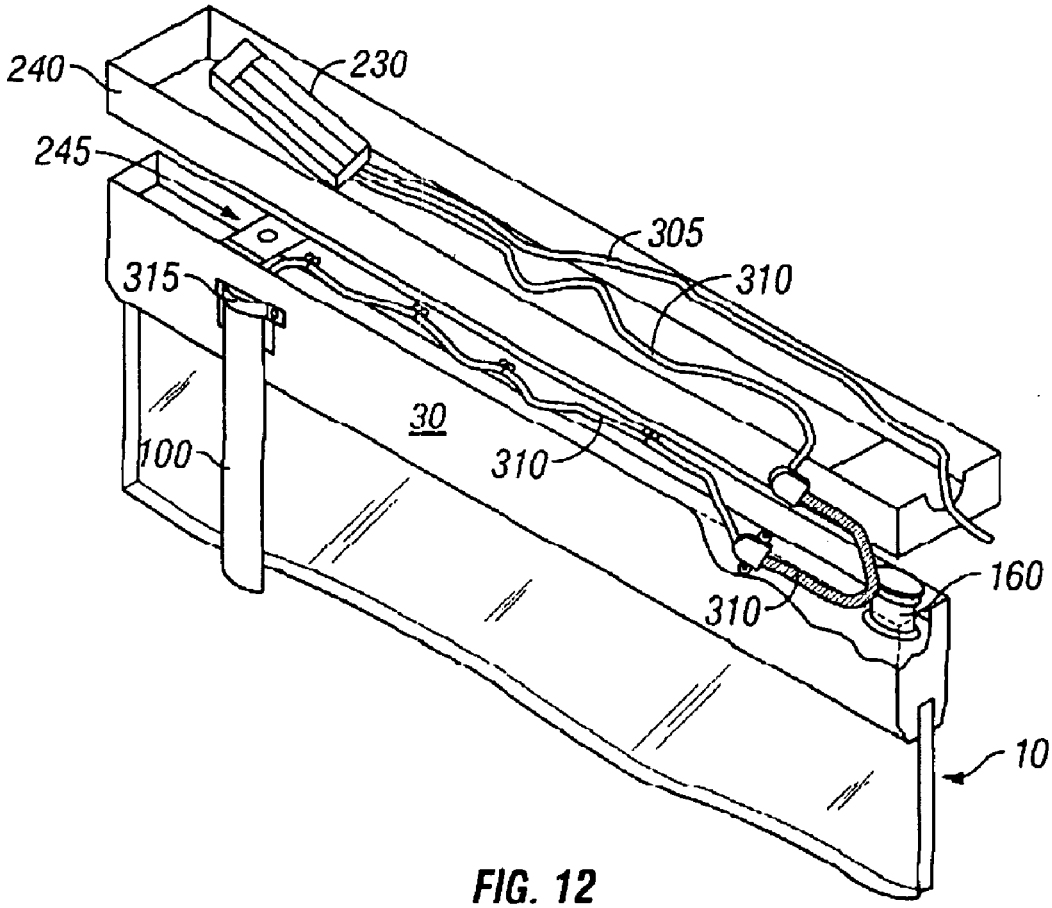
FIG. 12 is a perspective view of an embodiment of an electronic egress system in accordance with the present invention.
Figure 14:
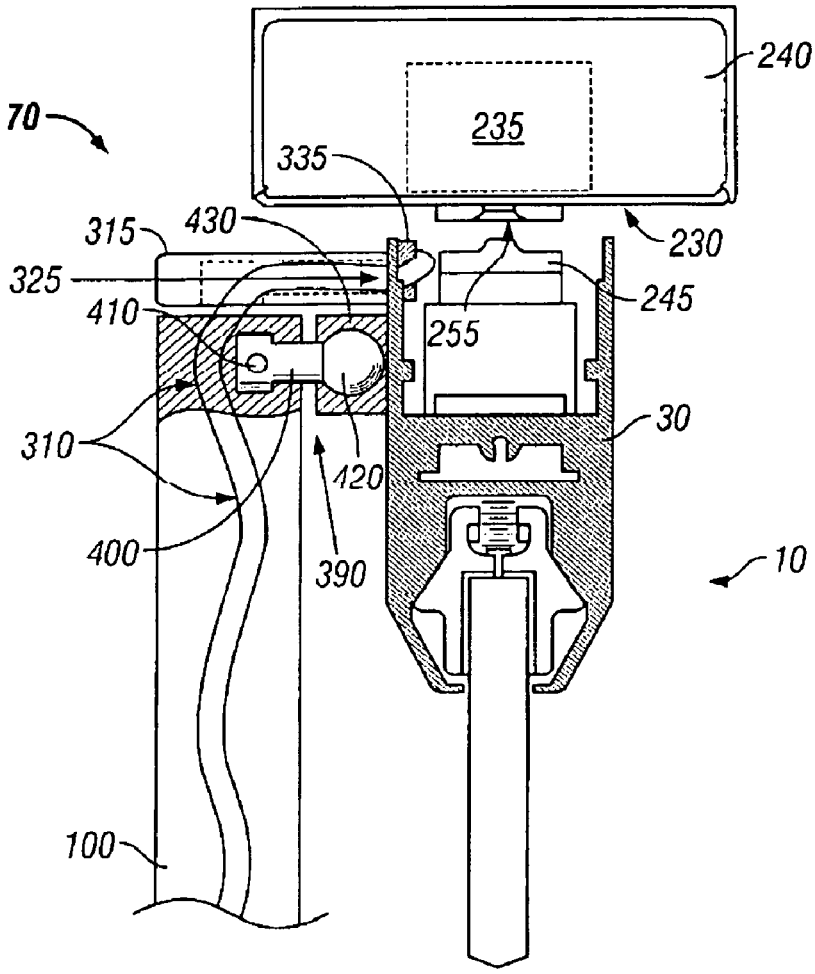
FIG. 14 is a cross-sectional view of an embodiment of an electronic egress system in accordance with the present invention.

As illustrated in FIGS. 12 and 14, the lock assembly 230 (also referred to as "latching assembly") is located within top door rail 30 and header 240 above door 10. However, as would be understood to one of ordinary skill in the art, the lock assembly 230 may also be located within the top door rail 30 or bottom door rail 40 or beneath the door 10, such as within or beneath a threshold or plate in the floor beneath the door, without departing from the scope of the present invention. In some embodiments, the lock assembly 230 comprises an electromagnetic lock 230 and includes an electromagnetic assembly 235 in the header 240 and an armature 245 located within top door rail 30. The armature 245 is dimensioned to fit at least partially within a similarly shaped opening 255 in the electromagnetic assembly 235. Activation or de-activation of the lock 230 causes the armature 245 to disengage from the electromagnetic assembly 235, which unlocks the door 10. Electromagnetic assembly 235 may comprise a single component or plural components. The lock 230 is powered by a power source (not shown) through wires 305 in header 240. According to other embodiments, the electromagnetic lock 230 is activated by a solenoid, wherein the header 240 houses a solenoid-activated locking mechanism. In one type of locking mechanism, a latching member (not shown) is retracted by actuation of the locking mechanism. As the latching member is retracted, it is withdrawn from corresponding receiving area in the top door rail 30 or bottom door rail 40, and thereby unlatching or unlocking the system.

Upon application of a pushing force on handle 150, the exit control device 180 moves toward the actuator post 110.

When sufficient force is applied, the actuator post 110 enters an aperture 250 in tubing 220 and pushes on a first end 260 of the linkage 210, which causes a second end 270 of the linkage 210 to depress button 280 activating the switch 190. The force applied must be large enough to overcome the bias of coil spring 290 and leaf spring 300. It should be noted that in one embodiment, actuator post 110 extends through aperture 250, while handle 150 is in a resting position. Upon a force input 2, the actuator post 110 extends further within aperture 250 and if handle 150 moves far enough, the actuator post engages first end 260 of linkage 210 or otherwise actuates the switch 4.

According to some embodiments, the switch 190 is an analog switch 190 that sends an analog electronic signal through wires 310. As best seen in FIGS. 9, 12 and 14, the wires 310 are threaded through bar 100, through conduit 315, into top door rail 30 through aperture 325 and wire fastener 335, laterally through the top door rail 30 toward the hinge 160 side of the door 10, and then from the top door rail 30 and into the header 240. The wires 310 then proceed laterally away from the hinge 160 side through the header 240 and to the lock 230. The electronic signal from the switch flows through the wires 310 and activates or deactivates the lock 230, which causes the door 10 to unlock and be opened. Activating the switch 190 changes the electronic state in the wires 310, which in turn changes the electronic state in the lock 230 within header 240. In other words, the analog signal is transmitted via the wires 310 from the switch 190 to the lock 230 instructing it to unlock.

According to other embodiments, the switch 190 acts as an analog/digital converter, whereby pushing on the door handle 50 causes the teeter-totter linkage 210 to activate the switch 190. In this embodiment, the switch 190 sends a digital signal through the wires 310 to the lock 230, which is digitally triggered to open.

Figure 13:
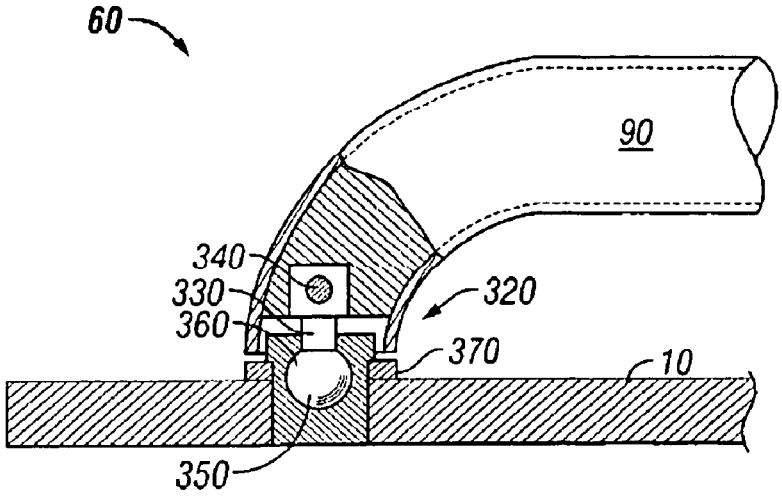
FIG. 13 is a cross-sectional view of an embodiment of an electronic egress system in accordance with the present invention.

With further reference to FIG. 2, the handle 50 is mounted to the glass door 10 at a pair of pivot points 60,70. The pivot points 60,70 permit the movement of the handle 50 required to activate the switch 190. As seen in FIG. 13, at pivot point 60, the horizontal bar 90 is bent to facilitate attachment to the door 10 via pivot assembly 320. The pivot assembly 320 includes a pivot member 330 having a pivot base 340 fixedly mounted within the horizontal bar 90 and a pivot ball 350 pivotally mounted within a socket 360. An annular flange 370 surrounds the socket 360 preventing air and water from seeping in. The socket 360 may be inserted within a mounting hole 380 drilled into the glass door 10.

As seen in FIG. 14, at pivot point 70, the vertical bar 100 is attached to the top door rail 30 by pivot assembly 390. Pivot assembly 390 includes a pivot member 400 having a pivot base 410 fixedly mounted within the vertical bar 100 and a pivot ball 420 pivotally mounted within socket 430. The socket 430 maybe attached to the top door rail 30 by any suitable structure, including, but not limited to screws, bolts, adhesive, or it may otherwise be integrally formed therewith. The wires 310 pass through the vertical bar 100, through the flexible conduit 315 and into top door rail 30. The flexible conduit 315 is bendable to allow for movement of the vertical bar 100 when activating the switch 190.

Thus, it is seen that an electronic egress system is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. An electronic egress system, comprising:

door panel;

an at least partially hollow movable component defining an enclosed interior space and movably mounted to the door panel whereby the movable component can move relative to the door panel upon being activated by a force input;

a switch assembly mounted within the interior space of the movable component outputting a switch signal when activated by displacement of the movable component relative to the door panel; and a latching assembly responsive to the switch signal, wherein the movable component is attached to the door panel at a pair of pivot points, and wherein the switch assembly mounted within the interior space of the movable component is movable relative to the door panel.

2. The electronic egress system of claim 1 further including a switch signal path assembly.

3. The electronic egress system of claim 2 wherein the switch signal path assembly includes an electrically conductive path from the switch assembly to the latching assembly.

4. The electronic egress system of claim 3 further comprising:

a top door rail assembly; and wherein the movable component is a door handle extending to the top door rail assembly;

the door panel is pivotally mounted to a door header about a pivot axis;

the latching assembly is situated in the door header above the top door rail assembly; and the electrically conductive path includes conductive wires extending from the switch assembly through the interior space of the door handle to the top door rail assembly and extending in the top door rail assembly towards the pivot axis, out of the top door rail assembly and into the door header above the top door rail assembly and to the latching assembly.

5. The electronic egress system of claim 3 further comprising:

a bottom door rail assembly; and wherein the movable component is a door handle extending to the top door rail assembly;

the door panel is pivotally mounted to a door frame about a pivot axis;

the latching assembly is situated in the door frame beneath the bottom door rail assembly; and the electrically conductive path includes conductive wires extending from the switch assembly through the space of the door handle to the bottom door rail assembly and extending in the bottom door rail assembly towards the pivot axis, out of the bottom door rail assembly and into the door frame below the bottom door rail assembly and to the latching assembly.

6. The electronic egress system of claim 1 wherein the switch assembly includes a momentary contact switch.

7. The electronic egress system of claim 1 wherein:

the switch signal includes a wireless signal; and the latching assembly includes a wireless signal receiver.

8. The electronic egress system of claim 1, wherein the latching assembly comprises an electromagnetic lock.

9. The electronic egress system of claim 1, further comprising:

an aperture formed in the movable component providing access into the interior space of the movable component;

an actuator protruding from a surface of the door panel at a location proximate to the aperture of the movable component.

10. The electronic egress system of claim 9 wherein the actuator is adapted to engage the switch assembly in the interior space of the movable component.

11. A method of opening an electronically actuated egress system comprising:

mechanically engaging a switch assembly located in an enclosed interior space defined by at least a partially hollow movable component, by displacing the movable component relative to a door panel, wherein the movable component is attached to the door panel at a pair of pivot points and the switch assembly located in the enclosed interior space is movable relative to the door panel;

outputting a switch signal from a switch assembly responsive to the mechanical engagement; and actuating a latching assembly responsive to the switch signal.

12. The method of claim 11 further comprising providing a force input to the movable component thereby displacing the movable component relative to the door panel.

13. The method of claim 11 further comprising actuating a momentary contact switch in said switch assembly.

14. The method of claim 11 further comprising transmitting said switch signal to said latching assembly via a switch signal path.

15. The electronic egress system of claim 11 wherein the step of displacing the movable component includes displacing a door handle relative to a door panel a predetermined distance sufficient to actuate the switch assembly.

16. The electronic egress system of claim 11, wherein mechanically engaging the switch assembly includes moving the movable component relative to an actuator protruding from the door panel at a location proximate to an aperture of the movable component.

17. A electronically actuated egress system comprising:

an at least partially hollow movable component means defining an enclosed interior space and displaceable relative to a door panel;

means for outputting a switch signal from a switch assembly positioned within the interior space and responsive to displacing the movable component; and means for actuating a latching assembly responsive to the switch signal, wherein the movable component is attached to the door panel at a pair of pivot points, and wherein the switch assembly is movable relative to the door panel.

18. The method of claim 17 wherein the means for outputting a switch signal further comprises a means for imparting a momentary contact within said means for outputting a switch signal.

19. An electronic egress system, comprising:

a movable component defining an interior space and movably mountable to a door panel and defining an aperture providing access into the interior space;

a switch assembly mounted within the interior space of the movable component outputting a switch signal when activated by displacement of the movable component, the switch assembly being movable relative to the door panel;

a latching assembly responsive to the switch signal; and an actuator mountable to protrude from the door panel at a location proximate to the aperture of the movable component.

* * * * *